US009897092B2

(12) United States Patent
Koga et al.

(10) Patent No.: US 9,897,092 B2
(45) Date of Patent: Feb. 20, 2018

(54) COMPRESSOR AND TURBO CHILLER

(71) Applicant: MITSUBISHI HEAVY INDUSTRIES, LTD., Tokyo (JP)

(72) Inventors: Jun Koga, Tokyo (JP); Shintaro Omura, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 276 days.

(21) Appl. No.: 14/655,030

(22) PCT Filed: Jul. 26, 2013

(86) PCT No.: PCT/JP2013/070330

§ 371 (c)(1),
(2) Date: Jun. 23, 2015

(87) PCT Pub. No.: WO2014/103416

PCT Pub. Date: Jul. 3, 2014

(65) Prior Publication Data

US 2015/0345507 A1 Dec. 3, 2015

(30) Foreign Application Priority Data

Dec. 28, 2012 (JP) ..... 2012-288891

(51) Int. Cl.
*F04D 17/12* (2006.01)
*F04D 29/42* (2006.01)
(Continued)

(52) U.S. Cl.
CPC ..... *F04D 17/122* (2013.01); *F01D 9/026* (2013.01); *F04D 17/12* (2013.01); *F04D 25/02* (2013.01);
(Continued)

(58) Field of Classification Search
CPC .. F04D 29/4213; F04D 29/444; F04D 29/286; F04D 29/4293; F04D 17/12;
(Continued)

(56) References Cited

U.S. PATENT DOCUMENTS 820,439 A * 5/1906 Ray ..... F04D 29/4213 415/183
1,269,063 A * 6/1918 De Laval ..... F04D 29/4213 415/183
(Continued)

FOREIGN PATENT DOCUMENTS

FR 982583 A * 6/1951 ..... F04D 29/462
FR 2636681 A1 * 3/1990 ..... F04D 29/462
(Continued)

OTHER PUBLICATIONS

English translation of FR 982583.*
(Continued)

*Primary Examiner* — Ninh H Nguyen
*Assistant Examiner* — Topaz L Elliott
(74) *Attorney, Agent, or Firm* — Birch, Stewart, Kolasch & Birch, LLP

(57) ABSTRACT

A compressor (2) characterized by being equipped with: a rotary shaft (12); multiple impellers attached to the rotary shaft; a main flow path that guides a fluid from the prior-stage impeller to the latter-stage impeller; a chamber (31) that forms a circle centered around the axial line and connects to the main flow path; a suction nozzle (32) that guides the fluid from the outer circumferential side toward the inner circumferential side in the chamber; multiple movable vanes provided in the main flow path at intervals in the circumferential direction of the axial line and capable of moving and thereby adjusting the flow volume of the fluid passing through the main flow path; and a drive mechanism
(Continued)

(42) that is provided at one side in the circumferential direction of the suction nozzle (32) within the chamber (31), and that changes the angle of the multiple movable vanes. In addition, of the one side and the other side in the circumferential direction within the chamber (31), the suction nozzle (32) is inclined toward the other side so as to increase the flow volume of the fluid toward the other side.

13 Claims, 7 Drawing Sheets

(51) Int. Cl.
*F01D 9/02* (2006.01)
*F04D 29/46* (2006.01)
*F04D 25/02* (2006.01)
*F25B 1/053* (2006.01)

(52) U.S. Cl.
CPC ..... *F04D 25/028* (2013.01); *F04D 29/4206* (2013.01); *F04D 29/4213* (2013.01); *F04D 29/462* (2013.01); *F05D 2210/43* (2013.01); *F05D 2250/51* (2013.01); *F25B 1/053* (2013.01)

(58) Field of Classification Search
CPC .... F04D 17/122; F01D 9/026; F05D 2210/43; F05D 2250/51
See application file for complete search history.

(56) References Cited

U.S. PATENT DOCUMENTS

| | | | | |
|---|---|---|---|---|
| 6,994,518 | B2 * | 2/2006 | Simon | F01D 17/141 415/147 |
| 7,559,742 | B2 * | 7/2009 | Inoue | F04D 29/4213 415/184 |
| 2002/0014088 | A1 | 2/2002 | Seki et al. | |
| 2011/0311356 | A1 * | 12/2011 | Masutani | F04D 29/441 415/203 |
| 2012/0201701 | A1 | 8/2012 | Hansen et al. | |
| 2012/0288365 | A1 * | 11/2012 | Bagnall | F01D 5/141 415/208.1 |

FOREIGN PATENT DOCUMENTS

| | | | | | |
|---|---|---|---|---|---|
| GB | 545858 | A | * | 6/1942 | F04D 29/462 |
| JP | 56-39897 | U | | 4/1981 | |
| JP | 61-101699 | A | | 5/1986 | |
| JP | 8-165996 | A | | 6/1996 | |
| JP | 9-79192 | A | | 3/1997 | |
| JP | 2002-48098 | A | | 2/2002 | |
| JP | 2002-327700 | A | | 11/2002 | |
| JP | 3653005 | B2 | | 5/2005 | |
| JP | 2006-63895 | A | | 3/2006 | |
| JP | 2006-200489 | A | | 8/2006 | |
| JP | 2007-309154 | A | | 11/2007 | |
| JP | 2010-523898 | A | | 7/2010 | |
| JP | 2010-203251 | A | | 9/2010 | |
| WO | WO 2008/124758 | A1 | | 10/2008 | |
| WO | WO 2010/098032 | A1 | | 9/2010 | |

OTHER PUBLICATIONS

English translation of FR 2636681.*
International Search Report (Form PCT/ISA/210) for International Application No. PCT/JP2013/070330, dated Oct. 15, 2013, with an English translation.
Written Opinion of the International Searching Authority (Form PCT/ISA/237) for International Application No. PCT/JP2013/070330, dated Oct. 15, 2013, with an English translation.

* cited by examiner

COMPRESSOR AND TURBO CHILLER

CROSS REFERENCE TO RELATED APPLICATIONS

This application is the National Phase of PCT International Application No. PCT/JP2013/070330, filed on Jul. 26, 2013, which claims under 35 U.S.C. 119(a) to Patent Application No. 2012-288891, filed in Japan on Dec. 28, 2012, all of which are hereby expressly incorporated by reference into the present application.

TECHNICAL FIELD

The present invention relates to a compressor and a turbo chiller which is provided with the compressor.

BACKGROUND ART

A turbo chiller is a large-capacity heat source device which is widely used in applications such as air conditioning of a large-scaled factory having a clean room, such as an electrical and electronic related factory, or district heating and cooling. As the turbo chiller, a turbo chiller unitized by disposing configuration devices such as a compressor, a condenser, and a vaporizer near each other and integrating the configuration devices is known (refer to, for example, PTL 1).

As the turbo chiller, a type in which a two-stage centrifugal compressor is used as a compressor and an intercooler is joined to the downstream of a first compression stage is known. Specifically, a gas refrigerant cooled in the intercooler is introduced to the downstream of the first compression stage through an intermediate suction chamber which surrounds an inlet portion of a second impeller configuring a second compression stage, and a slit formed between the intermediate suction chamber and a suction flow path provided around the inlet portion of the second impeller.

Further, in the turbo chiller having such a centrifugal compressor, in order to control an operating range of the chiller, movable vanes in which an angle is changed according to the operation conditions are respectively provided in impellers configuring the first compression stage and the second compression stage. The movable vane is driven by a driving device integrally provided in the centrifugal compressor. However, a portion (referred to as a drive mechanism) of the driving device is installed in the intermediate suction chamber.

Usually, the drive mechanism which is installed in the intermediate suction chamber is installed at the position of 180° in a circumferential direction from a suction nozzle for introducing a gas refrigerant into the intermediate suction chamber, that is, the farthest position with respect to the suction nozzle, in order to reduce the distribution in a circumferential direction of a flow at the joining position between an outlet of the intermediate suction chamber and a main flow path.

Further, PTL 2 discloses a centrifugal compressor having a shape which leads a large quantity of fluid to one side in a circumferential direction in order to make the centrifugal compressor compact, in a suction flow path for introducing the fluid into an impeller of the centrifugal compressor.

CITATION LIST

Patent Literature

[PTL 1] Japanese Unexamined Patent Application Publication No. 2002-327700

[PTL 2] Japanese Unexamined Patent Application Publication No. 8-165996

SUMMARY OF INVENTION

Technical Problem

Incidentally, as shown in FIGS. 6 and 7, a unitized turbo chiller 101 of the related art is disposed compactly to some extent, because major devices are intensively disposed. The turbo chiller 101 of the related art has, as main components, a centrifugal compressor 2 which compresses a gas refrigerant, a condenser 3 which condenses and liquefies the gas refrigerant compressed in the centrifugal compressor 2, an intercooler 4 (an economizer) which temporarily stores a liquid refrigerant condensed in the condenser 3 and performs intermediate cooling, and a vaporizer 5 which vaporizes the liquid refrigerant which is led from the intercooler 4.

The respective devices are connected by pipes. For example, a discharge pipe 7 for leading the refrigerant after compression to the condenser 3, and a suction pipe 8 which sucks in the gas refrigerant from the vaporizer 5 are connected to the centrifugal compressor 2. Further, the intercooler 4 and the centrifugal compressor 2 are connected by a gas refrigerant pipe for an intercooler 9 which leads the gas refrigerant from a gas phase section of the intercooler 4 to an intermediate stage of the centrifugal compressor 2. The driving device 37 described above is integrally provided in the centrifugal compressor 2.

However, the turbo chiller 101 of the related art does not have a fully satisfactory layout when considering that a plurality of turbo chillers are adjacently disposed or staked at the time of storage or transportation.

In order to realize the compacting of a device, it is conceivable to optimize the arrangement of a compressor by changing the position of, for example, the above-described drive mechanism, or the like. However, in this case, there is a possibility that the drive mechanism may make flow distribution in a circumferential direction in an intermediate suction chamber non-uniform.

Further, in the centrifugal compressor described in PTL 2, a drive mechanism is not provided, and in addition, a fluid is guided to one side in the circumferential direction according to the circumstances of the shape of the suction flow path, and the uniformity of flow distribution after guidance is not taken into account.

The present invention provides a compressor in which it is possible to make the overall layout compact, and a turbo chiller which is provided with the compressor.

Solution to Problem (1) According to a first aspect of the present invention, there is provided a compressor including: a rotary shaft which rotates around an axis line; a plurality of impellers mounted on the rotary shaft; a main flow path which guides a fluid from the impeller of a preceding stage to the impeller of a subsequent stage; a chamber which has a ring shape centered on the axis line and communicates with the main flow path; a suction nozzle which introduces the fluid into the chamber toward an inner periphery side from an outer periphery side; a plurality of movable vanes which are provided in the main flow path at intervals in a circumferential direction with respect to the axis line and are movable, thereby adjusting a flow rate of the fluid flowing through the main flow path; and a drive mechanism which is provided on one side in the circumferential direction of the suction nozzle in the chamber and changes angles of the plurality of movable vanes, wherein the suction nozzle is inclined toward the other side out of one side and the other side in the circumferential direction in the chamber such that the flow rate of the fluid to the other side increases.

According to the above configuration, the drive mechanism is provided on one side in the circumferential direction of the suction nozzle, whereby the arrangement of the compressor is optimized, and thus it is possible to make the overall layout of a turbo chiller compact. Further, the suction nozzle is inclined, whereby a flow rate flowing to the side opposite to the drive mechanism increases, and thus flow distribution in the circumferential direction in the chamber becomes more uniform.

(2) In the compressor according to the above (1), it is preferable that a guide blade which guides the fluid such that the flow rate of the fluid to the other side out of one side and the other side in the circumferential direction in the chamber increases is provided on an outlet side of the suction nozzle.

According to the above configuration, the fluid is guided by the guide blade, whereby it is possible to further improve the uniformity of the flow distribution in the circumferential direction in the chamber.

(3) In the compressor according to the above (2), it is preferable that the guide blade is formed such that a length thereof becomes longer toward the other side in the circumferential direction.

According to the above configuration, the flow rate of the fluid further flows into the side opposite to the drive mechanism, and thus it is possible to improve the uniformity of the flow distribution in the circumferential direction in the chamber.

(4) In the compressor according to any one of (1) to (3), it is preferable that a flow path guide formed so as to make a flow path of the chamber narrower as it goes toward the drive mechanism is provided in the chamber.

According to the above configuration, since the fluid is guided to the vicinity of the drive mechanism by the flow path guide, it is possible to further improve the uniformity of the flow distribution in the circumferential direction in the chamber.

(5) In the compressor according to any one of (1) to (4), it is preferable that the drive mechanism is provided at a position spaced apart by 90° in the circumferential direction with respect to the suction nozzle.

(6) Further, according to a second aspect of the present invention, there is provided a turbo chiller including: the compressor according to any one of (1) to (5).

Advantageous Effects of Invention

According to the compressor related to each of the above aspects of the present invention, the drive mechanism is provided on one side in the circumferential direction of the suction nozzle, whereby the arrangement of the compressor is optimized, and thus it is possible to make the overall layout of a turbo chiller compact. Further, the suction nozzle is inclined, whereby a flow rate flowing to the side opposite to the drive mechanism increases, and thus the flow distribution in the circumferential direction in the chamber becomes more uniform.

DESCRIPTION OF EMBODIMENTS

First Embodiment

Hereinafter, an embodiment of the present invention will be described in detail with reference to the drawings. A turbo chiller of this embodiment has, as main components, a centrifugal compressor, a condenser which condenses and liquefies a gas refrigerant compressed in the centrifugal compressor, an intercooler which temporarily stores a liquid refrigerant condensed in the condenser and performs intermediate cooling, and a vaporizer which vaporizes the liquid refrigerant which is led from the intercooler, basically similar to the turbo chiller of the related art. Then, configuration devices such as the compressor, the condenser, and the vaporizer are disposed near each other and integrated with each other, thereby being unitized.

Figure 1:
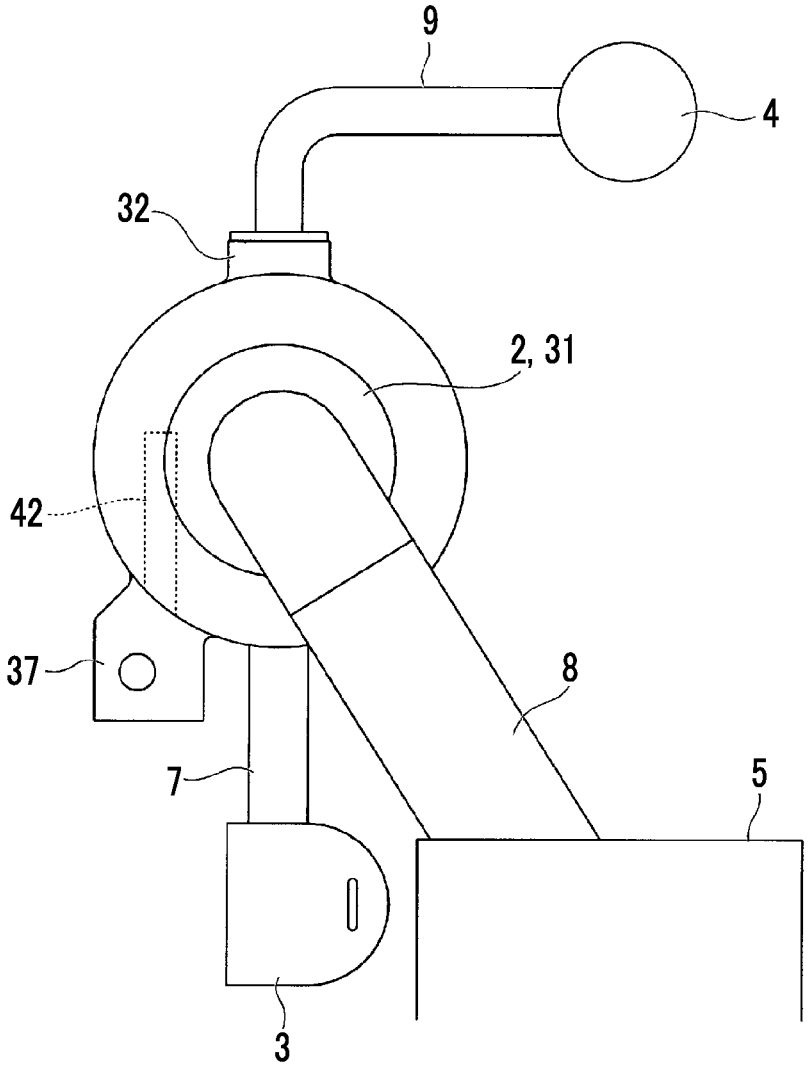
FIG. 1 is a front view showing the configuration of the periphery of a centrifugal compressor of a turbo chiller according to a first embodiment of the present invention.

As shown in FIG. 1, a suction pipe 8 which sucks in a gas refrigerant from the vaporizer is connected to a centrifugal compressor 2 of the turbo chiller of this embodiment, and an intercooler 4 and the centrifugal compressor 2 are connected by a gas refrigerant pipe for an intercooler 9 which leads the gas refrigerant from a gas phase section of the intercooler to an intermediate stage of the centrifugal compressor 2. The gas refrigerant which is supplied from the gas refrigerant pipe for an intercooler 9 is introduced into an intermediate suction chamber 31 of the centrifugal compressor 2 through a suction nozzle 32.

In addition, a condenser 3, the intercooler 4, and a vaporizer 5 shown in FIG. 1 are schematically shown and the accurate arrangement thereof in the turbo chiller of this embodiment is not reflected.

A driving device 37 which drives a second movable vane 36 (refer to FIGS. 2 and 3), which will be described later, is integrally provided in the centrifugal compressor 2. A drive mechanism 42 such as a bracket 41 (refer to FIG. 4) and a drive shaft 39 (refer to FIG. 4), of the driving device 37, is installed in the intermediate suction chamber 31.

Then, in the turbo chiller of this embodiment, in order to make the overall layout of the chiller compact (in order to reduce an installation area), the drive mechanism 42 which is a portion of the driving device 37 is disposed at the position of 90° in a circumferential direction with respect to the suction nozzle 32.

Figure 2:
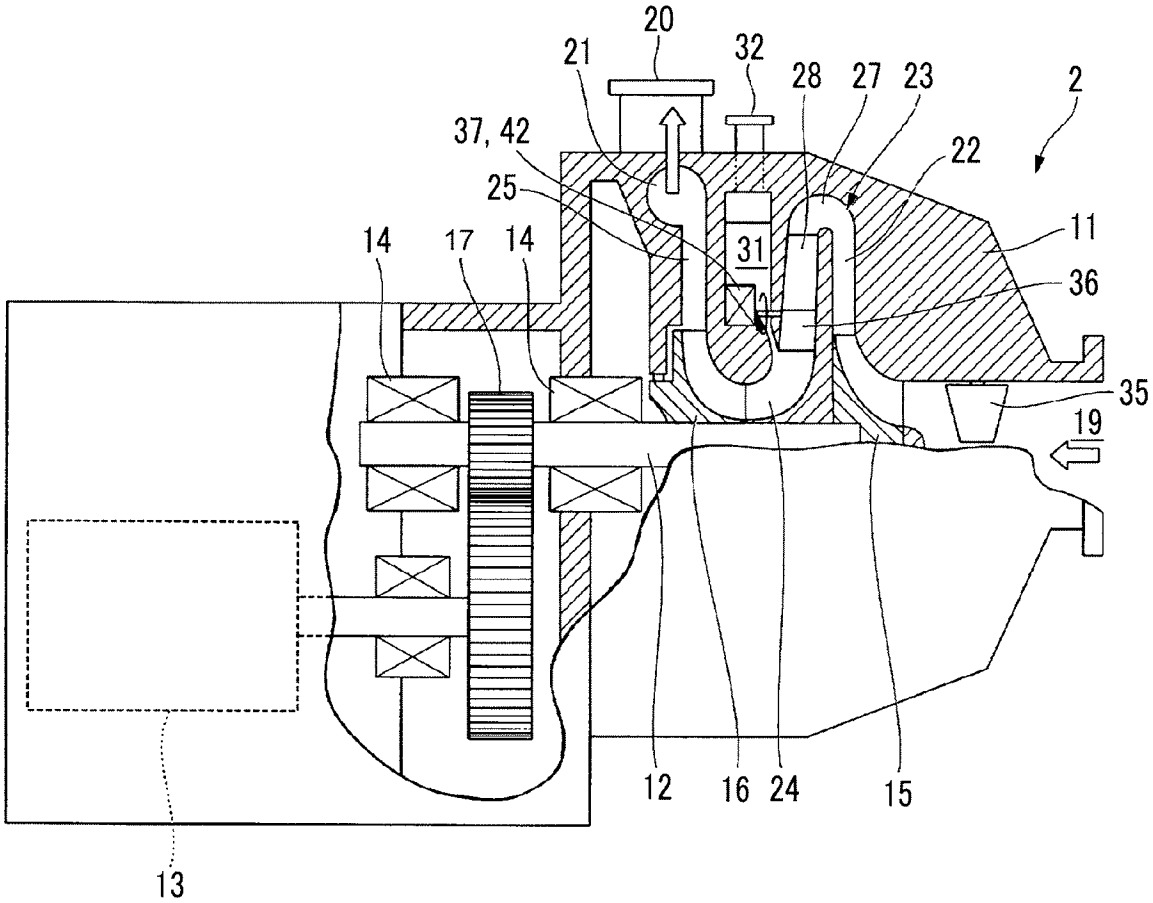
FIG. 2 is a cross-sectional view showing an internal structure of a centrifugal compressor according to the first embodiment of the present invention.
Figure 3:
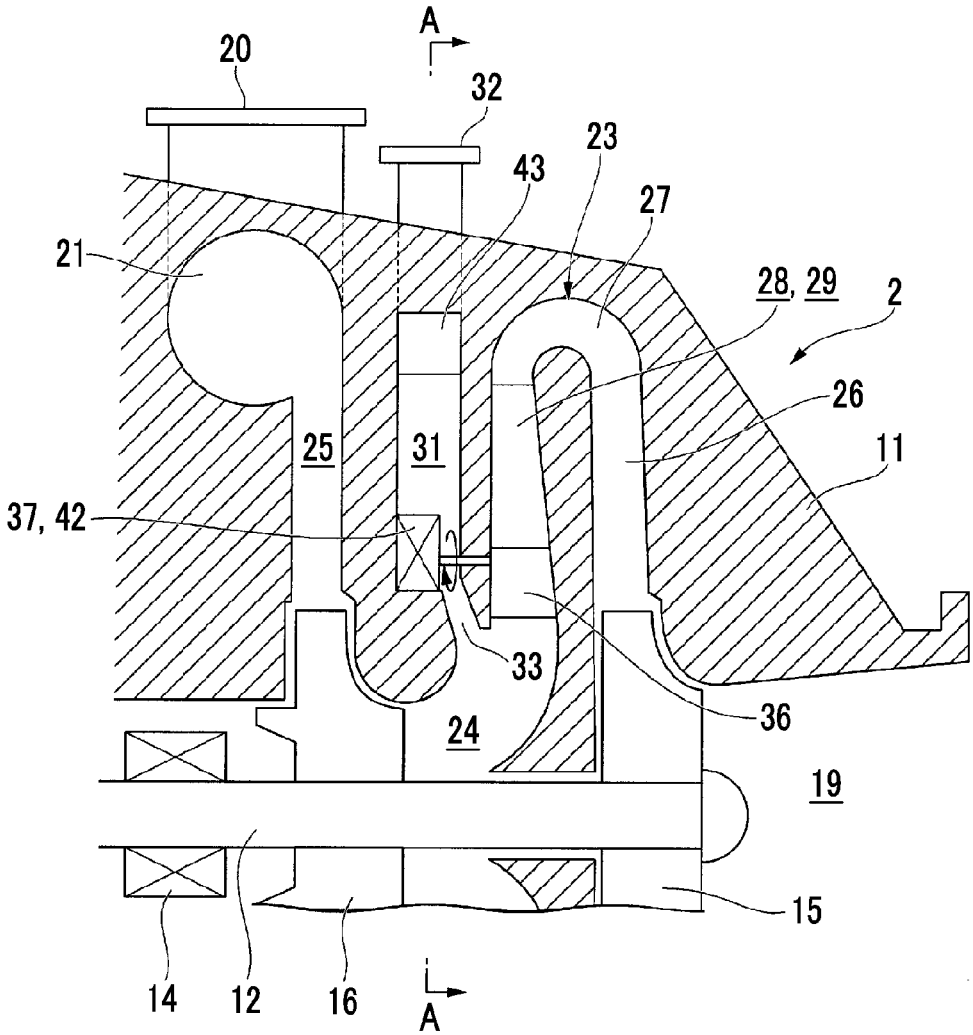
FIG. 3 is a cross-sectional view showing a partial configuration of the centrifugal compressor shown in FIG. 2.

As shown in FIGS. 2 and 3, the centrifugal compressor 2 has a casing 11 which forms an outline, a rotary shaft 12 rotatably supported in the casing 11, a motor 13 which rotationally drives the rotary shaft 12, and a first impeller 15 and a second impeller 16 disposed to be spaced apart from each other in an axis line direction at the rotary shaft 12.

The rotary shaft 12 is rotatably supported on the casing 11 through a pair of bearings 14. The driving force of the motor 13 is transmitted to the rotary shaft 12 through a gear mechanism 17, and the first impeller 15 and the second impeller 16 also rotate according to the rotation of the rotary shaft 12. A suction port 19 is provided on one side in the axis line direction of the casing 11 and a discharge port 20 is provided on the other side in the axis line direction. Further, an internal space 21 which makes the suction port 19 and the discharge port 20 communicate with each other is formed in the casing 11.

The first impeller 15 and the second impeller 16 are disposed in the internal space 21, and the first impeller configures a first compression stage and the second impeller 16 configures a second compression stage. The internal space 21 is provided with a return flow path 23 connected to a flow path outlet 22 of the first impeller 15, and a suction flow path 24 which connects the return flow path 23 and the second impeller 16. The suction flow path 24 is an annular passage provided around an inlet portion of the second impeller 16.

The return flow path 23 makes the gas refrigerant flow toward a flow path inlet on the inside in a radial direction of the second impeller 16 from the flow path outlet 22 on the outside in the radial direction of the first impeller 15. The return flow path 23 has a diffuser portion 26, a bend portion 27, and a return portion 28. The diffuser portion 26 guides the gas refrigerant compressed by the first impeller 15 and discharged radially outward from the flow path outlet 22 of the first impeller 15, to the outside in the radial direction. The outside in the radial direction of the diffuser portion 26 communicates with the return portion 28 through the bend portion 27.

Figure 7:
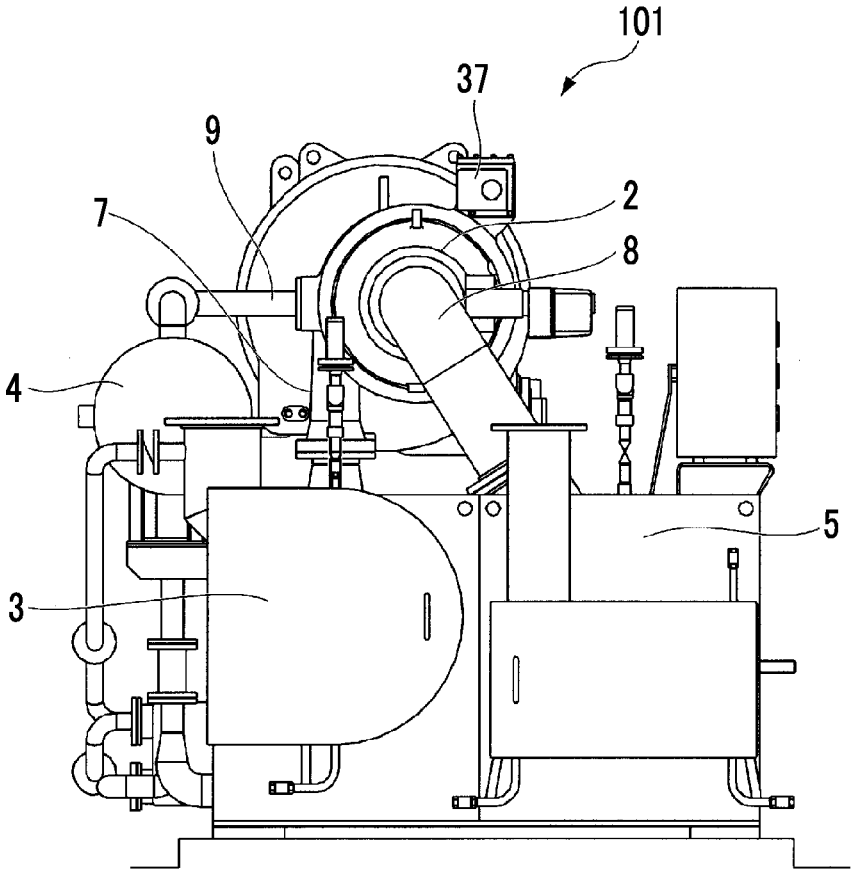
FIG. 7 is a front view of the turbo chiller of the related art.

Further, the gas refrigerant compressed in the second impeller 16 is discharged from the discharge port 20 of the casing 11 to a discharge flow path 7 (refer to FIG. 7) by way of a discharge passage 25 provided around the second impeller 16.

A return vane 29 is disposed radially over the entire circumstances on the downstream side of the bend portion 27.

Further, in the centrifugal compressor 2, the intermediate suction chamber 31 which causes the gas refrigerant that is generated in the intercooler 4 to join a discharge flow of the first impeller 15 and be then supplied to the second impeller 16 is provided. The intermediate suction chamber 31 is formed as an annular space surrounding the inlet portion of the second impeller 16. The gas refrigerant from the intercooler 4 is supplied to the intermediate suction chamber 31 through the suction nozzle 32. The suction nozzle 32 is connected to the gas refrigerant pipe for an intercooler 9 (refer to FIG. 1).

In an inner peripheral portion of the intermediate suction chamber 31, a slit 33 is provided over the entire circumference, and thus the inside of the intermediate suction chamber 31 and the suction flow path 24 of the second impeller 16 are connected.

Further, a first movable vane 35 in which an angle can be changed according to the operation conditions is provided at an inlet of the first impeller 15 of the first compression stage in the suction port 19 of the centrifugal compressor 2. In addition, the second movable vane 36 in which an angle can be changed according to the operation conditions is provided at an inlet of the second impeller 16 of the second compression stage in the suction flow path 24 of the return flow path 23.

Figure 4:
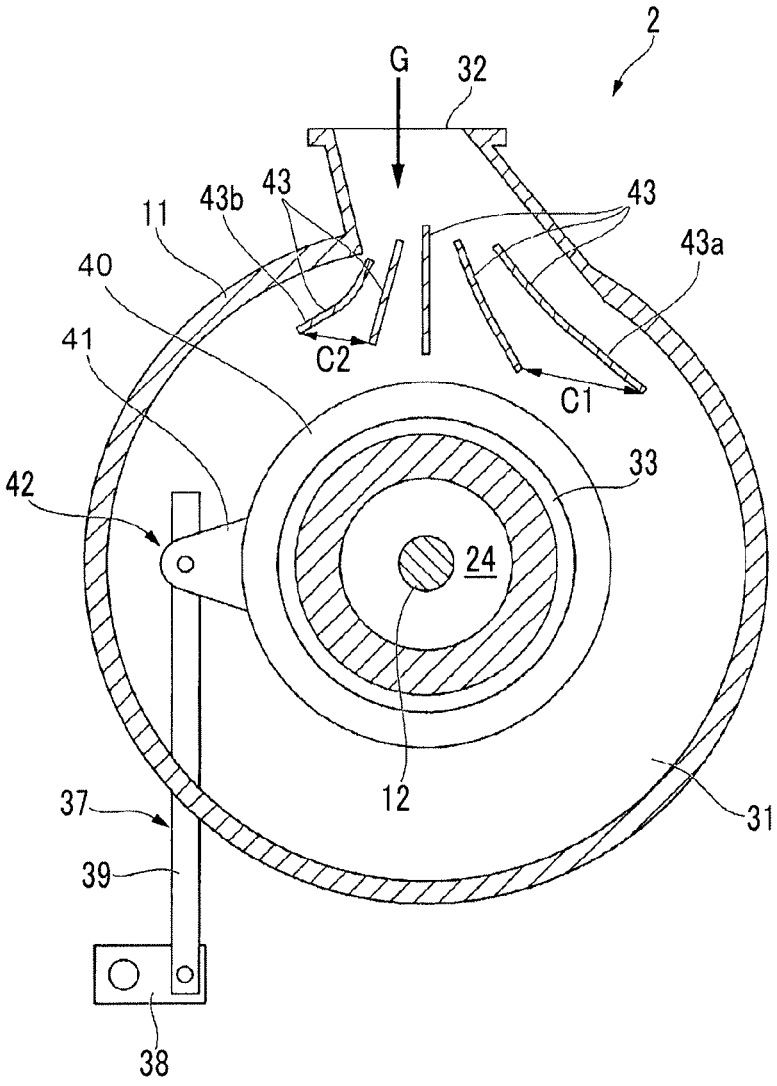
FIG. 4 is a cross-sectional view taken along line A-A of FIG. 3.

As shown in FIG. 4, the driving device 37 for driving the second movable vane 36 is provided in the centrifugal compressor 2. The driving device 37 has a drive motor 38 provided outside the casing 11, the drive shaft 39 which moves over a predetermined range in a horizontal direction orthogonal to the axis line direction by the rotation of the drive motor 38, a drive ring 40 which rotates over a predetermined angle according to the movement of the drive shaft 39, and the bracket 41 which connects the drive ring 40 and the drive shaft 39. The second movable vane 36 is connected to the drive ring 40 by a predetermined link mechanism.

Hereinafter, an operation of the driving device 37 will be described. First, if the drive motor 38 is driven, the driving force of the drive motor 38 is transmitted to the drive shaft 39 through a predetermined gear. The drive shaft 39 moves in a longitudinal direction by the driving force, thereby operating the bracket 41.

Subsequently, the bracket 41 operates the drive ring 40, whereby the drive ring 40 rotates in the circumferential direction. In this way, the angle of the second movable vane 36 connected to the drive ring 40 through a predetermined link mechanism is changed.

The drive ring 40, the bracket 41, and a portion of the drive shaft 39 of the driving device 37 are disposed in the intermediate suction chamber 31. The bracket 41 and a portion of the drive shaft 39 disposed in the intermediate suction chamber 31 are hereinafter referred to as the drive mechanism 42.

Further, a plurality of guide blades 43 are provided close to an opening of the suction nozzle 32 in the intermediate suction chamber 31. The guide blade 43 is a plate-shaped guide provided so as to connect an inner wall on one side in the axis line direction of the intermediate suction chamber 31 and an inner wall on the other side in the axis line direction and has a shape diffusing the gas refrigerant which is introduced from the suction nozzle 32 to both sides in the circumferential direction of the intermediate suction chamber 31.

As described above, in the turbo chiller of this embodiment, in order to make the overall layout of the chiller compact (in order to reduce an installation area), the drive mechanism 42 which is a portion of the driving device 37 is disposed at the position of 90° in the circumferential direction with respect to the suction nozzle 32. That is, the drive mechanism 42 is provided on one side in the circumferential direction of the suction nozzle 32 in the intermediate suction chamber 31.

Here, the suction nozzle 32 of the intermediate suction chamber 31 is inclined such that the flow rate of the gas refrigerant to the side opposite to the side on which the drive mechanism 42 is provided increases. That is, the suction nozzle 32 is formed such that the flow rate of the gas refrigerant to the other side in the circumferential direction in the intermediate suction chamber 31 increases.

Specifically, a flow path area orthogonal to a gas introduction direction G of the suction nozzle 32 is formed such that the side opposite to the drive mechanism 42 is larger.

Further, also with regard to the guide blades 43, the guide blades 43 are formed such that the flow rate of the gas refrigerant becomes larger on the other side in the circumferential direction, that is, such that the length of the guide blade 43 on the side opposite to the drive mechanism 42 becomes longer.

Specifically, the plurality of guide blades 43 are formed so as to become longer as the distance from the drive mechanism 42 increases. For example, a guide blade 43s most distant from the drive mechanism 42 is made longer than (for example, double) a guide blade 43*b* closest to the drive mechanism 42.

Further, the plurality of guide blades 43 are disposed such that the distance between the guide blades 43 adjacent to each other becomes wider as the distance from the drive mechanism 42 increases. For example, a distance C1 between downstream-side end portions of the guide blade 43*a* which is at the position most distant from the drive mechanism 42 and the guide blade 43 disposed next to the guide blade 43*a* is disposed so as to be wider than a distance C2 between the guide blade 43*b* closest to the drive mechanism and the guide blade disposed next to the guide blade 43*b*.

Next, an operation of the turbo chiller of this embodiment will be described.

In the turbo chiller of this embodiment, the vaporizer 5, the centrifugal compressor 2, the condenser 3, and the intercooler 4 are connected by the pipes, thereby configuring a closed system which circulates a refrigerant. The gas refrigerant introduced from the gas phase section of the intercooler 4 of these devices is introduced into the intermediate suction chamber 31 of the centrifugal compressor 2 by the suction nozzle 32.

The gas refrigerant having flowed into the intermediate suction chamber 31 flows into a suction passage of the second impeller 16 through the slit 33 and is sucked into the second impeller 16 along with refrigerant vapor discharged from the first impeller 15.

Further, the intercooler 4 and the centrifugal compressor 2 are connected by the gas refrigerant pipe for an intercooler 9 which leads the gas refrigerant from the gas phase section of the intercooler 4 to the intermediate stage of the centrifugal compressor 2.

According to the above-described embodiment, the arrangement of the centrifugal compressor 2 is optimized by providing the drive mechanism 42 at the position spaced apart by 90° in the circumferential direction on one side in the circumferential direction of the suction nozzle 32, and thus it is possible to make the overall layout of the turbo chiller compact.

Further, the suction nozzle 32 is inclined, whereby the flow rate flowing to the side opposite to the drive mechanism 42 increases, and thus the flow distribution in the circumferential direction in the intermediate suction chamber 31 becomes more uniform.

Further, the length of the guide blade 43 is formed so as to become longer as the distance from the drive mechanism 42 increases, and the distance between the guide blades 43 is disposed so as to become wider as the distance from the drive mechanism 42 increases, whereby the gas refrigerant further flows into the side opposite to the drive mechanism 42, and thus the uniformity of the flow distribution in the circumferential direction in the intermediate suction chamber 31 is improved.

In this way, a bias in the circumferential direction of the flow in the outlet of the intermediate suction chamber 31 is suppressed, and therefore, it is possible to suppress a decrease in the performance of the second impeller 16 which is located downstream.

Second Embodiment

Next, a turbo chiller according to a second embodiment of the present invention will be described. In addition, in this embodiment, description is made focusing on the differences from the first embodiment described above and description of the same portions is omitted.

Figure 5:
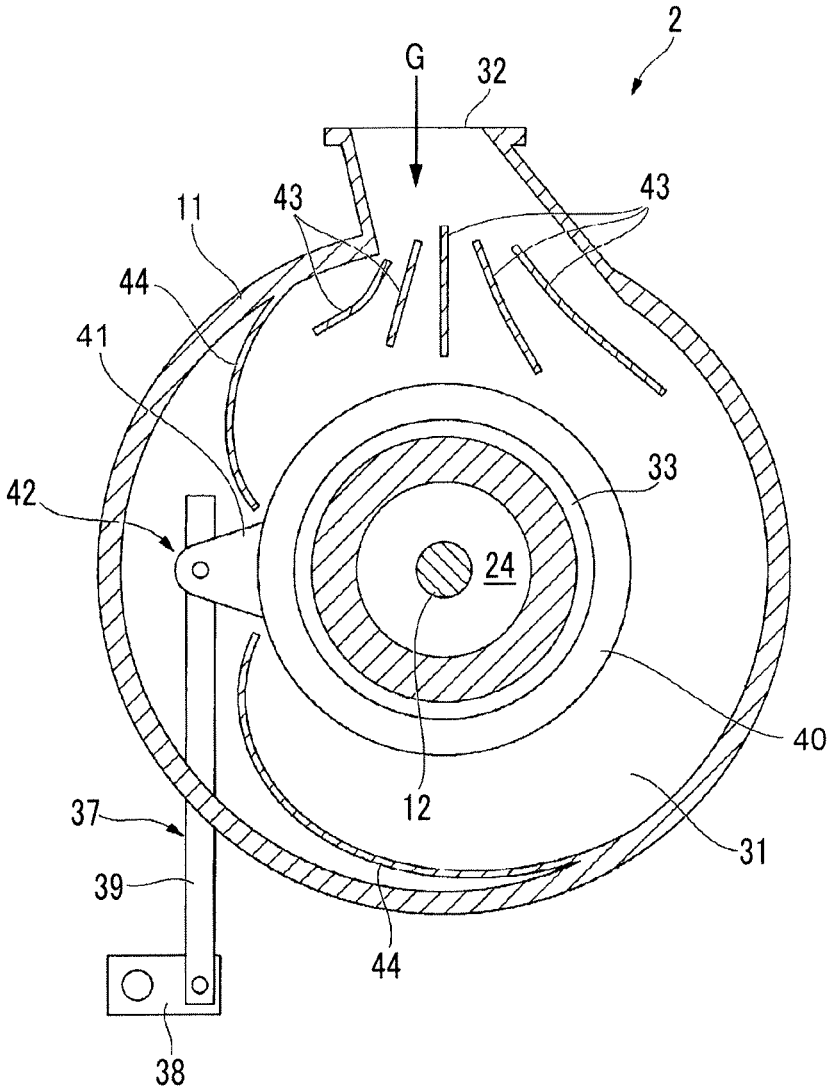
FIG. 5 is a cross-sectional view corresponding to FIG. 3, of a centrifugal compressor according to a second embodiment of the present invention.
Figure 6:
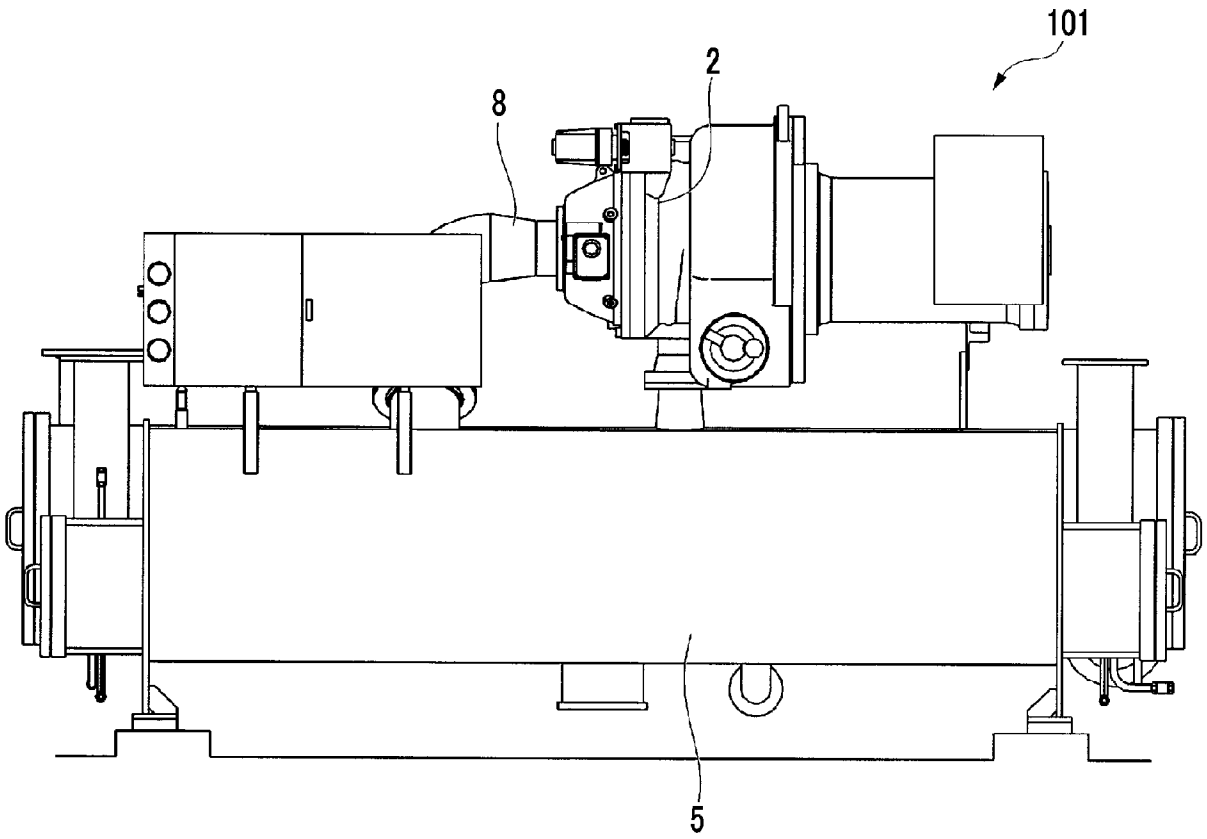
FIG. 6 is a side view of a turbo chiller of the related art.

As shown in FIG. 5, the centrifugal compressor 2 of the turbo chiller of this embodiment is characterized in that a flow path guide 44 making a flow path width become narrower as it approaches the drive mechanism 42 is provided in the intermediate suction chamber 31.

The flow path guide 44 is a plate-shaped guide provided so as to connect the inner wall on one side in the axis line direction of the intermediate suction chamber 31 and the inner wall on the other side in the axis line direction, similar to the guide blade 43. Specifically, the flow path guide 44 is a guide having a curved shape narrowing a flow path width further toward the drive mechanism 42 side than the suction nozzle 32 at the position spaced apart by 180° in the circumferential direction with respect to the suction nozzle 32 (on the side opposite to the suction nozzle 32).

According to the above-described embodiment, the flow path area in the circumferential direction of the inside of the intermediate suction chamber 31 is gradually narrowed by the flow path guide 44, whereby the gas refrigerant is led to the vicinity of the drive mechanism 42 with increased velocity. In this way, the uniformity of the flow distribution in the circumferential direction in the intermediate suction chamber 31 is improved.

In addition, the technical scope of the present invention is not limited to each of the embodiments described above and includes forms in which various changes are applied to the above-described embodiments within a scope which does not depart from the gist of the present invention. That is, the configurations and the like mentioned in the above-described embodiments are an example, and changes can be appropriately made.

For example, in this embodiment, a configuration in which the suction nozzle 32 and the drive mechanism 42 are spaced apart from each other by 90° in the circumferential direction is shown. However, there is no limitation thereto, and a configuration of making the entire device more compact by further narrowing the distance is also acceptable.

INDUSTRIAL APPLICABILITY

The above-described compressor and turbo chiller are suitable for a turbo chiller unitized by disposing configuration devices such as a compressor, a condenser, and a vaporizer near each other and integrating the configuration devices.

REFERENCE SIGNS LIST

1: turbo chiller
2: centrifugal compressor
3: condenser
4: intercooler
5: vaporizer
12: rotary shaft
15: first impeller
16: second impeller
21: internal space
23: return flow path
31: intermediate suction chamber (chamber)
32: suction nozzle
33: slit
36: second movable vane
37: driving device
39: drive shaft
40: drive ring
41: bracket
42: drive mechanism
43: guide blade
44: flow path guide

The invention claimed is:

1. A compressor comprising:

a rotary shaft which rotates around an axis line;

a plurality of impellers mounted on the rotary shaft;

a main flow path which guides a fluid from the impeller of a preceding stage to the impeller of a subsequent stage;

a chamber which has a ring shape comprising a first semi-circumferential side and a second semi-circumferential side, is centered on the axis line, and is in fluid communication with the main flow path;

a suction nozzle which introduces the fluid into the chamber toward an inner periphery side from an outer periphery side;

a plurality of movable vanes which are provided in the main flow path at intervals in a circumferential direction with respect to the axis line and are movable, thereby adjusting a flow rate of the fluid flowing through the main flow path; and a drive mechanism which changes angles of the plurality of movable vanes, wherein the drive mechanism is provided in the first semi-circumferential side of the chamber with respect to the suction nozzle, and the suction nozzle is inclined toward the second semi-circumferential side of the chamber such that the flow rate of the fluid to the second semi-circumferential side increases.

2. The compressor according to claim 1, wherein a guide blade which guides the fluid such that the flow rate of the fluid to the second semi-circumferential side other side out of one side and the other side in the circumferential direction in the chamber increases is provided on an outlet side of the suction nozzle.

3. The compressor according to claim 2, wherein the guide blade is formed of a plurality of blades, where the length of each successive blade is greater than the previous blade, moving in a direction from the first semi-circumferential side to the second semi-circumferential side.

4. The compressor according to claim 3, wherein a flow path guide formed so as to make a flow path of the chamber narrower as it goes toward the drive mechanism is provided in the chamber.

5. The compressor according to claim 4, wherein the drive mechanism is provided at a position spaced apart by 90° in the circumferential direction with respect to the suction nozzle.

6. The compressor according to claim 3, wherein the drive mechanism is provided at a position spaced apart by 90° in the circumferential direction with respect to the suction nozzle.

7. The compressor according to claim 2, wherein a flow path guide formed so as to make a flow path of the chamber narrower as it goes toward the drive mechanism is provided in the chamber.

8. The compressor according to claim 7, wherein the drive mechanism is provided at a position spaced apart by 90° in the circumferential direction with respect to the suction nozzle.

9. The compressor according to claim 2, wherein the drive mechanism is provided at a position spaced apart by 90° in the circumferential direction with respect to the suction nozzle.

10. The compressor according to claim 1, wherein a flow path guide formed so as to make a flow path of the chamber narrower as it goes toward the drive mechanism is provided in the chamber.

11. The compressor according to claim 10, wherein the drive mechanism is provided at a position spaced apart by 90° in the circumferential direction with respect to the suction nozzle.

12. The compressor according to claim 1, wherein the drive mechanism is provided at a position spaced apart by 90° in the circumferential direction with respect to the suction nozzle.

13. A turbo chiller comprising: the compressor according to claim 1.

* * * * *